US009889983B2

(12) United States Patent
Buse et al.

(10) Patent No.: US 9,889,983 B2
(45) Date of Patent: Feb. 13, 2018

(54) CIGARETTE PACKAGE AND METHOD FOR PRODUCTION THEREOF

(71) Applicant: JT International S.A., Geneva (CH)

(72) Inventors: Henry Buse, Visselhövede (DE); Viktor Hein, Kirchlinteln-Luttum (DE); Burkard Roesler, Blender (DE)

(73) Assignee: JT International S.A. (CH)

( * ) Notice: Subject to any disclaimer, the term of this patent is extended or adjusted under 35 U.S.C. 154(b) by 0 days.

(21) Appl. No.: 14/394,724

(22) PCT Filed: Apr. 12, 2013

(86) PCT No.: PCT/EP2013/001070

§ 371 (c)(1),
(2) Date: Oct. 15, 2014

(87) PCT Pub. No.: WO2013/159869

PCT Pub. Date: Oct. 31, 2013

(65) Prior Publication Data

US 2015/0068931 A1 Mar. 12, 2015

(30) Foreign Application Priority Data

Apr. 25, 2012 (DE) ..... 10 2012 008 168

(51) Int. Cl.

| | |
|---|---|
| ***B65D 85/10*** | (2006.01) |
| ***B31B 50/26*** | (2017.01) |
| ***B31B 50/74*** | (2017.01) |

(52) U.S. Cl.

CPC ..... *B65D 85/1063* (2013.01); *B31B 50/26* (2017.08); *B31B 50/74* (2017.08); *B65D 85/1036* (2013.01)

(58) Field of Classification Search

CPC .. B65D 85/1063; B65D 85/1036; B31B 1/26; B31B 1/74

See application file for complete search history.

(56) References Cited

U.S. PATENT DOCUMENTS 1,877,468 A * 9/1932 L'Enfant ..... B65D 7/02 206/256
3,037,678 A * 6/1962 Caruso ..... B65D 5/721 206/268

(Continued)

FOREIGN PATENT DOCUMENTS

DE 102008035473.2 A1 2/2010
EP 2017198 B1 12/2009

OTHER PUBLICATIONS

International Search Report and English Translation for PCT/EP2013/001070 dated Jul. 25, 2013, 8 pages.

*Primary Examiner* — J. Gregory Pickett
*Assistant Examiner* — James Way
(74) *Attorney, Agent, or Firm* — Lerner, David, Littenberg, Krumholz & Mentlik, LLP

(57) ABSTRACT

The invention relates to a (cigarette) package consisting of an outer package (10) and two inner packages (11, 12). The latter can be moved by a pivoting movement about a respective articulation joint in the region of an outer base wall (40) out of the closed position (upright within the outer package (10)) into an oblique open position. To this end a covering tab (28) which closes off the cup-shaped inner package (11, 12) on the upper face is automatically moved out of the closed position, such that the oblique inner package (11, 12) is ready for the removal of the contents of the packaging.

15 Claims, 6 Drawing Sheets

(56) References Cited

U.S. PATENT DOCUMENTS

| | | | | | |
|---|---|---|---|---|---|
| 3,052,398 | A | | 9/1962 | Benjamin | |
| 3,058,646 | A | * | 10/1962 | Guyer | B65D 5/18 220/4.23 |
| 3,749,234 | A | * | 7/1973 | Gero | B65D 5/722 206/266 |
| 3,881,599 | A | | 5/1975 | Flaherty | |
| 4,641,748 | A | * | 2/1987 | Lewis | B65D 85/1036 206/251 |
| 7,320,399 | B2 | * | 1/2008 | Ghini | B65D 85/1045 206/268 |
| 7,712,607 | B2 | * | 5/2010 | Ghini | B65D 5/5213 206/242 |
| 8,418,845 | B2 | * | 4/2013 | Tawada | B65D 5/721 206/267 |
| 2008/0087562 | A1 | * | 4/2008 | Berger | B65D 5/5405 206/268 |
| 2009/0045084 | A1 | * | 2/2009 | Roila | B65D 85/1036 206/268 |
| 2010/0176010 | A1 | * | 7/2010 | Tearle | B65D 85/1036 206/256 |

* cited by examiner

11 / 12
13
14
15
16
17
18
19
22
23
24
25
26
28
29
30
32
33
40
41
42
43
44
45
46
47
49
50
51
52
53
55
56
57
58
59
60
61
62
66

*Fig. 7*
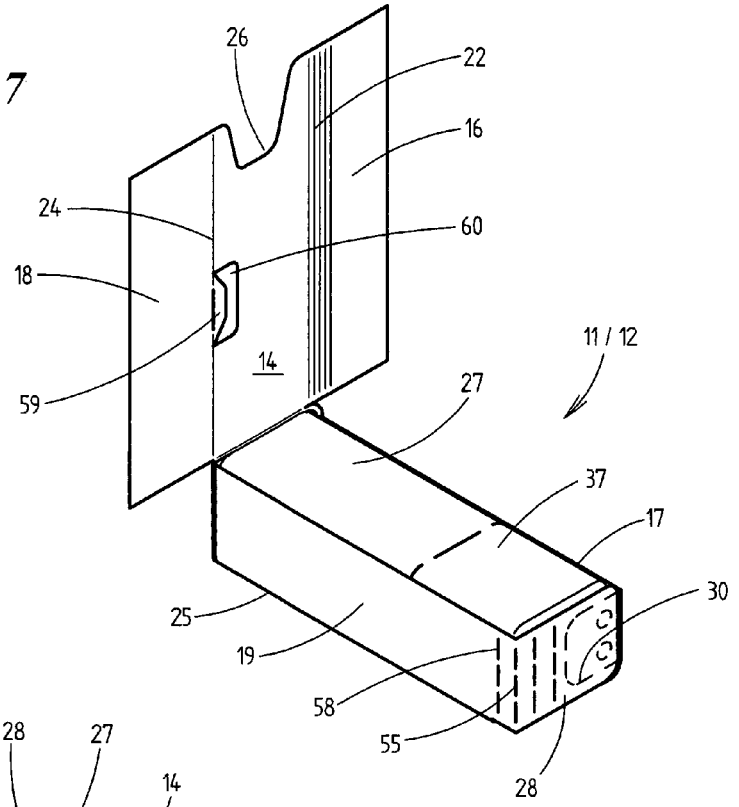
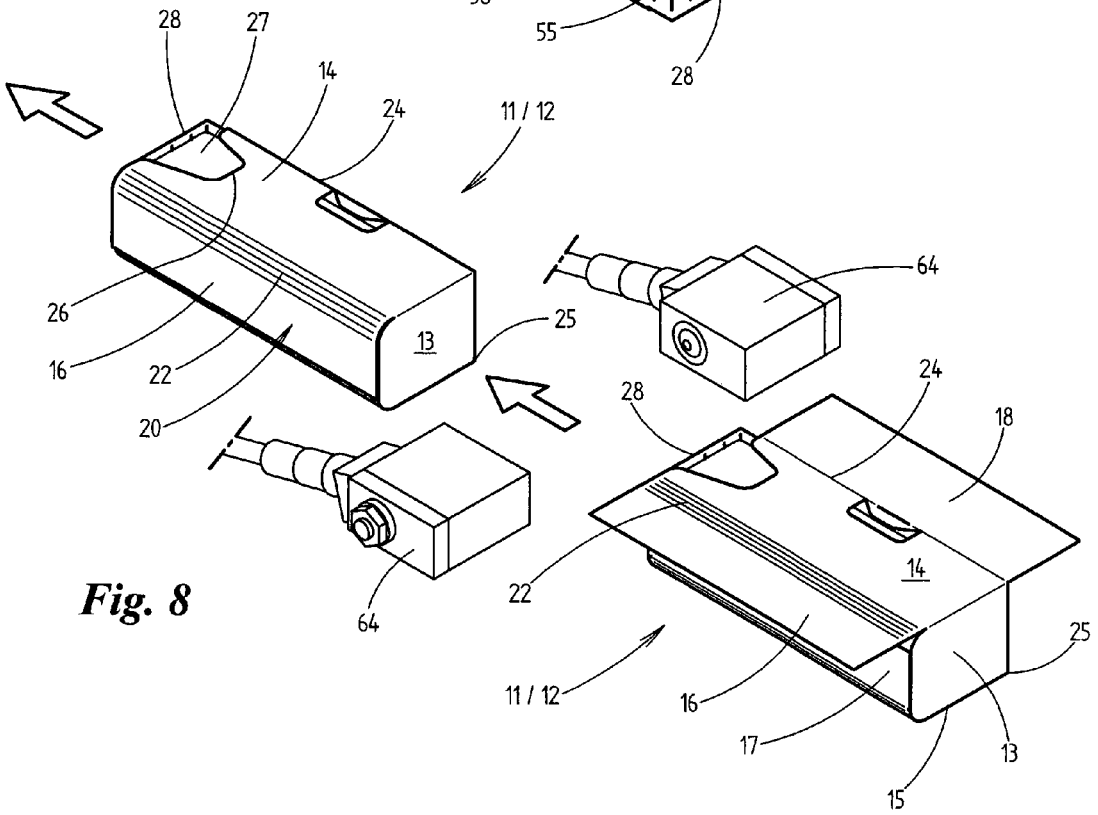
*Fig. 8*

CIGARETTE PACKAGE AND METHOD FOR PRODUCTION THEREOF

CROSS REFERENCE TO RELATED APPLICATIONS

The present application is a national stage application under 35 U.S.C. § 371 of International Application No. PCT/EP2013/001070, filed Apr. 12, 2013, published in German, which claims priority from German Patent Application No. 10 2012 008 168.5, filed Apr. 25, 2012, all of which are incorporated by reference herein in their entireties.

The invention relates to a packaging for piece goods, in particular for cigarettes, having the features of the preamble of claim 1. The invention also relates to methods for producing such (cigarette) packagings.

The present packaging (for cigarettes) is composed of an outer packaging and at least one inner packaging which is pivotable for the movement between an open position and a closed position, wherein said inner packaging is obliquely inclined when in the open position. It is preferable for two inner packagings to be arranged in a common outer packaging (EP 2 017 198 B1). In the case of said known design, the (two) inner packagings are, on the top side, either open or, in the case of a hinged-lid box embodiment, provided with a pivotable hinged lid. The blanks for the inner packagings are formed so as to be processed in accordance with the principle of longitudinal folding. Here, an inner base wall is adjoined, to both sides, by folding lobes for side walls on the one hand and for an outer wall and inner wall of the inner packaging on the other hand.

The invention is concerned with developments with regard to the configuration of such packagings and the field of technology for the production of said packagings. The object on which the invention is based is that of designing a (cigarette) packaging, with in particular two inner packagings, such that the packaging as a whole is appealing, easy to handle and dimensionally stable. The requirements for industrial production should also be met.

To achieve said object, the packaging according to the invention is formed with the features of claim 1.

The blank for the (two) inner packagings is accordingly designed in each case such that an inner base wall is adjoined, to both sides, by folding lobes for the side walls of the inner packaging. Said folding lobes are in turn adjoined, to both sides, by folding lobes which, for the formation of an outer wall on the one hand and an inner wall on the other hand, are folded so as to mutually overlap and are connected to one another (by means of adhesive). The outwardly directed free wall of the inner packaging—outer wall—is accordingly of double-layer form (as is the opposite inner wall). The side walls are composed of one material layer.

A further special feature consists in that the inner packagings, which in the open position are open at the top side, are covered in the closed position by a closing lobe or by two at least partially overlapping closing lobes. At least one closing lobe is formed as a continuation of the (inner) folding lobe of the inner wall. By connection to a face wall of the outer packaging, the closing lobe is actuated in the sense of an opening or closing movement during the opening and closing processes. Furthermore, the inner packagings are of cup-shaped form, wherein the side walls and outer wall and inner wall extend substantially over the full height (inner dimension) of the outer packaging.

It is also of significance from a production aspect that, owing to the design of the inner packaging, said inner packaging need only be produced in one design. Of the inner packagings supplied individually or in pairs (for example in the case of two-lane production) to an outer packaging, the second in each case is rotated through 180° in order to achieve the relative position corresponding to the overall packaging.

The production at least of the inner packaging is performed in accordance with the folding and filling concept specified in U.S. Pat. No. 4,084,393.

Further features of the packagings and of the production technique will be explained in more detail below on the basis of the drawings, in which.

Figure 5:
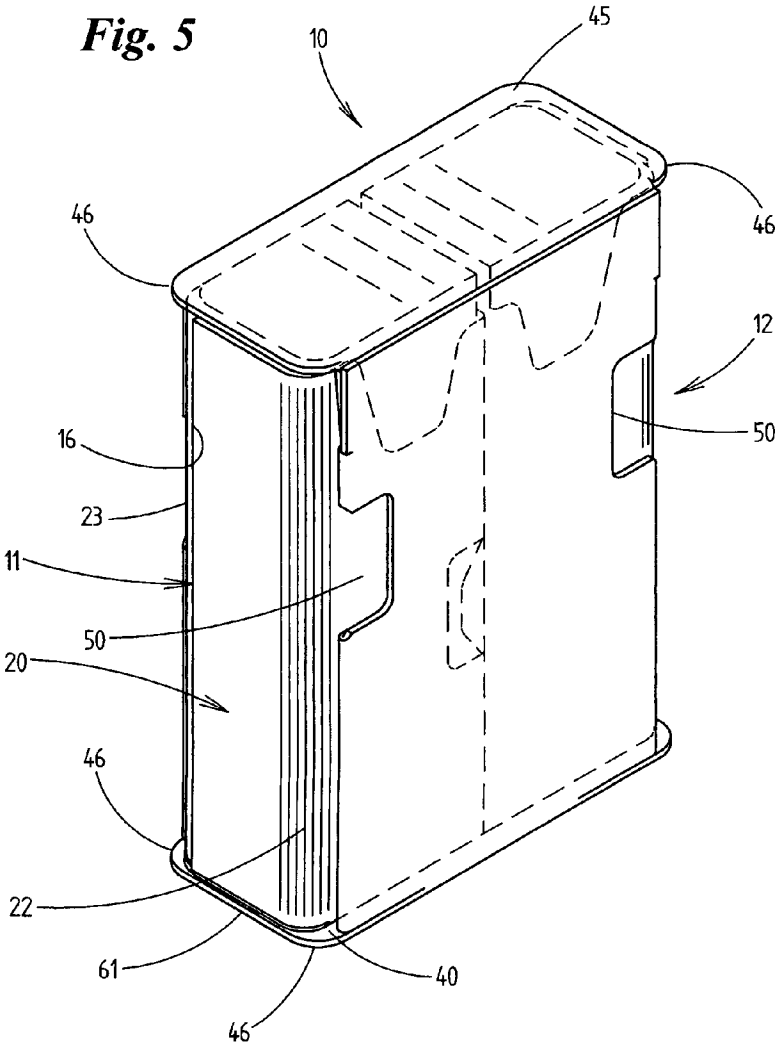
Figure 6:
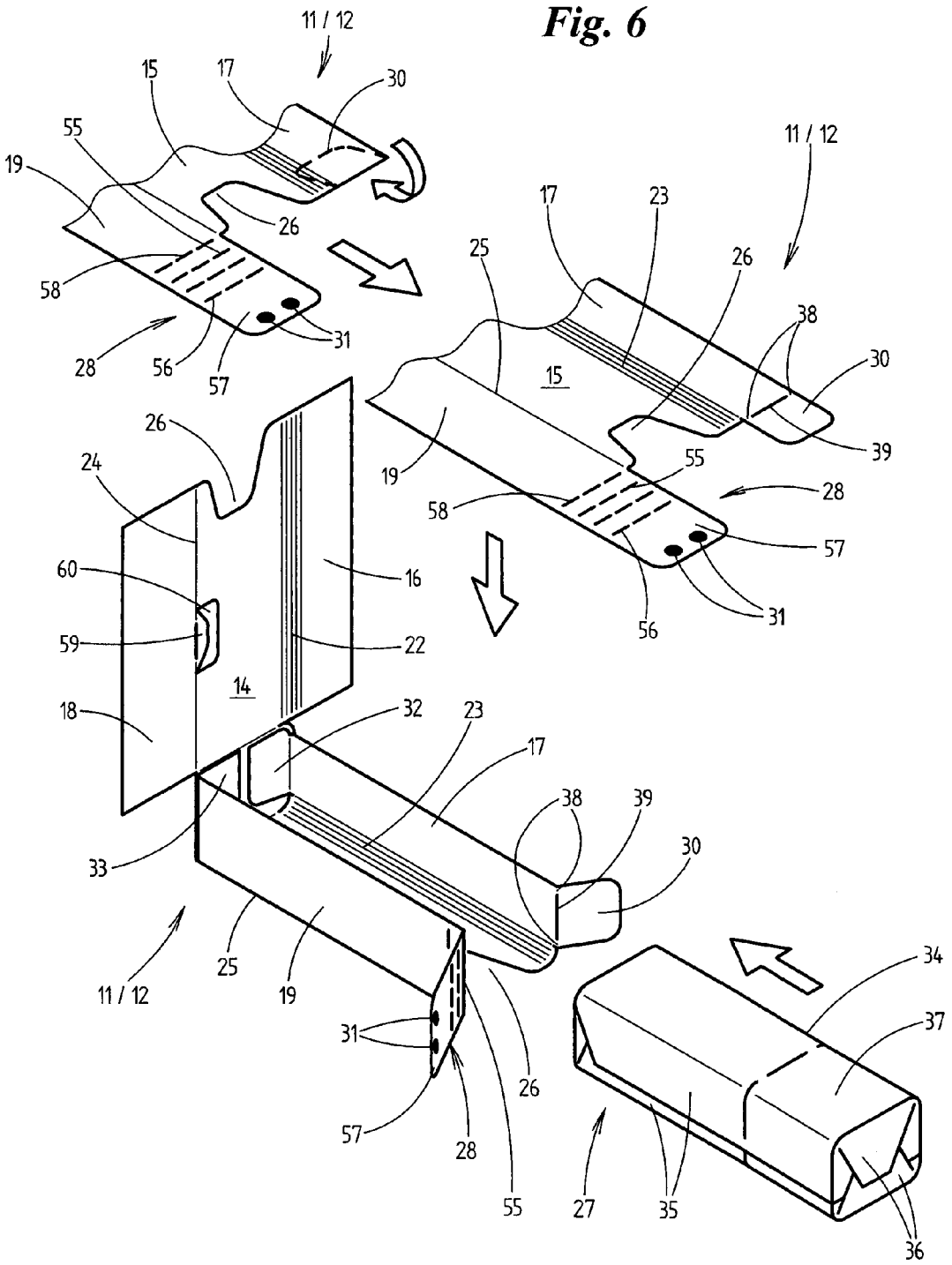
Figures 9, 10:
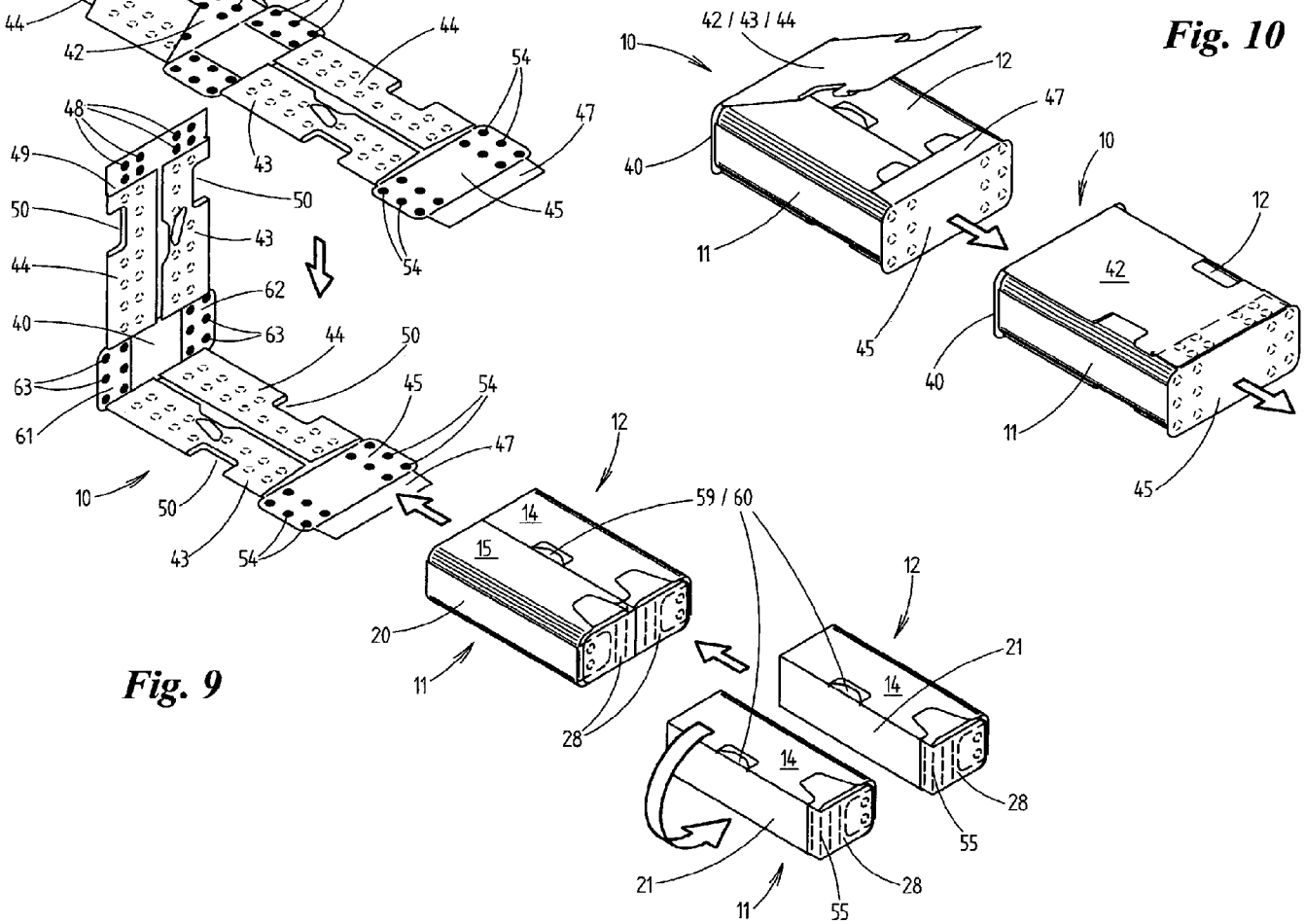
Figure 12:
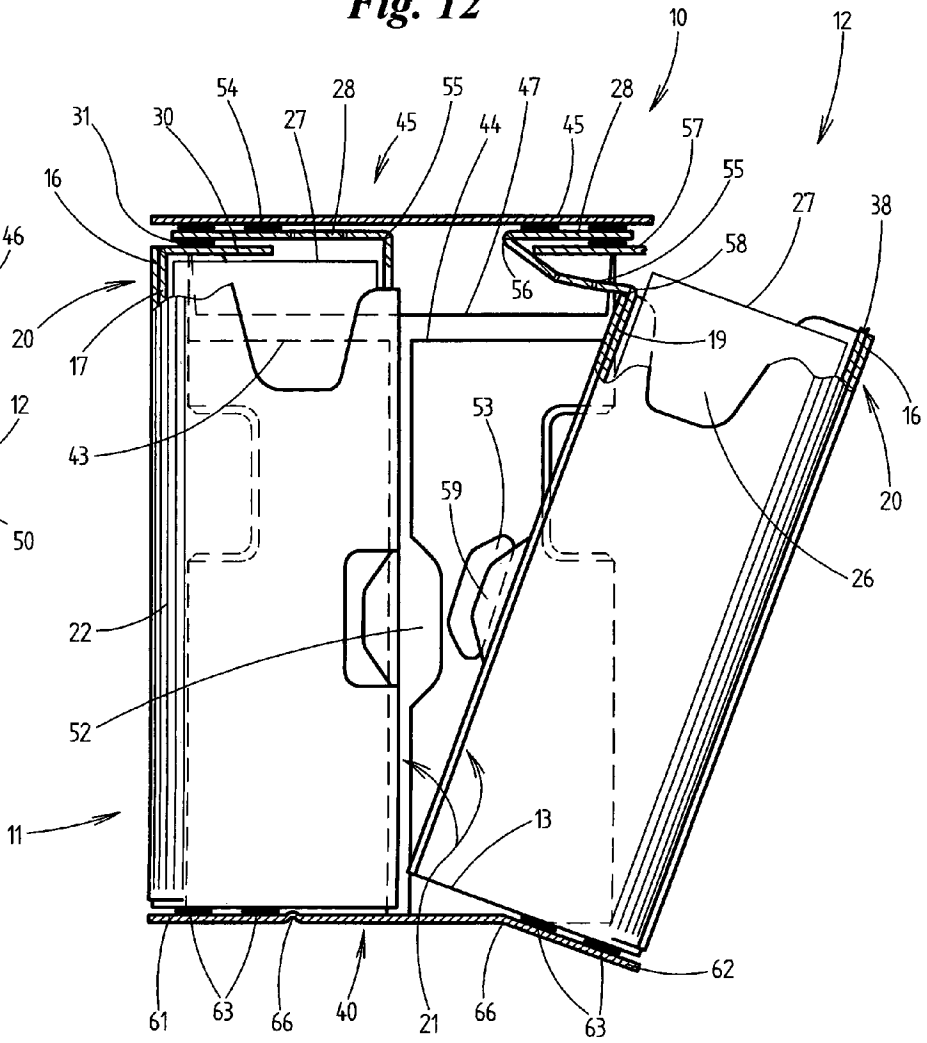
Figure 11:
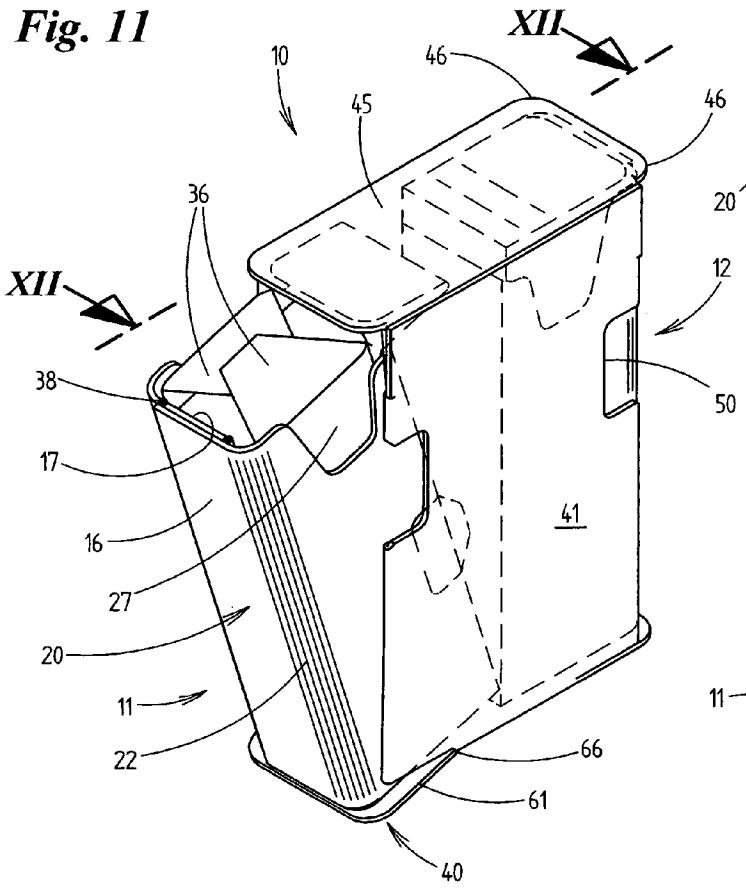

FIG. 5 shows a finished (overall) packaging, likewise in a perspective illustration, FIG. 6 shows first production steps for the production of an inner packaging, FIG. 7 shows the inner packaging in a partially finished position, in a perspective view, FIG. 8 shows final production steps for the inner packaging, likewise in a perspective view, FIG. 9 shows steps for the production of the complete packaging, in a perspective view, FIG. 10 shows final production steps for the packaging as per FIG. 5, in a perspective view, FIG. 11 shows the packaging in the open position of one inner packaging, in a perspective view, and FIG. 12 shows a vertical section through the packaging as per FIG. 11 in the section plane XII-XII in FIG. 11.

The preferred embodiment of a packaging for cigarettes is composed of three sub-packagings, specifically an outer packaging 10 and two inner packagings 11, 12. The latter are movably fixed in the common outer packaging 10. By means of pivoting movement, each inner packaging 11, 12 can be individually moved from a closed position (FIG. 5, FIG. 12, left-hand side) into an open position (FIG. 12, right-hand side). In said open position, the packaging contents (cigarettes) are accessible. The inner packagings 11, 12 are designed such that, in the closed position (FIG. 5), they substantially completely fill the interior of the outer packaging 10. Open narrow sides of the outer packaging 10 are completely covered by the inner packaging 11, 12.

Figures 1, 2, 3:
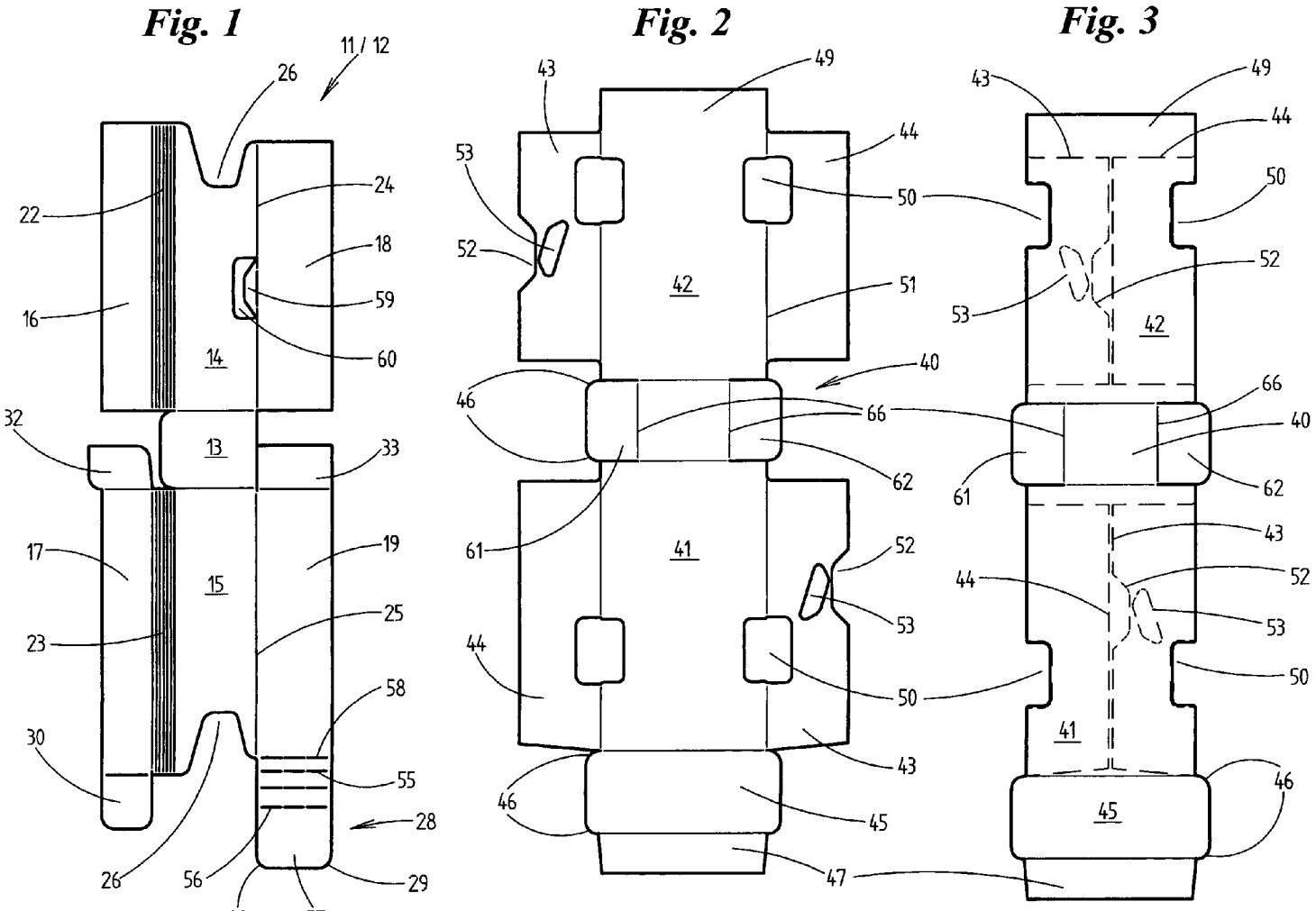
FIG. 1 shows an unfolded blank for an inner packaging.
FIG. 2 shows an unfolded blank for an outer packaging.
FIG. 3 shows the blank of the outer packaging after first folding steps.

Blanks for the inner packaging 11, 12 and outer packaging 10 are illustrated in FIG. 1 and FIG. 2 respectively in unfolded form. The blank of the inner packaging 11, 12 has a central region for forming an inner base wall 13. Connected to said inner base wall are mutually opposite folding lobes which form mutually opposite side walls 14, 15 in the inner packaging 11, 12. On the longitudinal sides of said folding lobes there are arranged further folding lobes, specifically an external outer lobe 16, an internal outer lobe 17, and opposite these, in each case an external inner lobe 18 and an internal inner lobe 19. By corresponding folding and mutual overlap, the lobes that are respectively assigned to one another, these being 16 and 17 on the one hand and 18 and 19 on the other hand, form an outer wall 20 and an inner wall 21 of the inner packaging 11, 12, which is thus closed in an encircling manner.

In the present case, the packaging is designed such that externally situated upright packaging edges formed by the inner packagings 11, 12 are in the form of rounded edges 22, 23. The blank for the inner packaging 11, 12 (FIG. 1) is, in the region of outwardly directed packaging edges for forming the rounded edges and 23, formed with a multiplicity of parallel grooves as a transition between the side wall 14 and external outer lobe 16 and also between the side wall and internal outer lobe 17, and opposite, specifically between side walls 14, 15 on the one hand and external inner lobe 18 and internal inner lobe 19 on the other hand, there is formed an embossed line for a packaging edge 24, 25 which is right-angled in cross section.

The inner packaging 11, 12 folded from the blank as per FIG. 1 is substantially of cup-shaped form, that is to say is open on the top side (withdrawal side) (FIG. 11, FIG. 12). The outer wall 20 with the folding lobes 16, 17 extends over the full height of the outer packaging 10 (inner dimension). The inner wall 21 is formed with a somewhat smaller height in order to permit the oblique inclination of the inner packaging 11, 12 during the opening and closing processes. The side walls 14, 15 are preferably both provided with a recess 26 which extends from an upper edge of the inner packaging 11, 12 and which ensures access to the cigarettes when the inner packaging 11, 12 is open. The dimensions are preferably selected such that packaging contents in block form, specifically a cigarette block 27—a group of cigarettes with an inner wrapping composed of paper, tinfoil or foil—have a slightly smaller height than the inner wall 21 and a somewhat smaller height than the outer wall 20 (FIG. 12).

Figure 4:
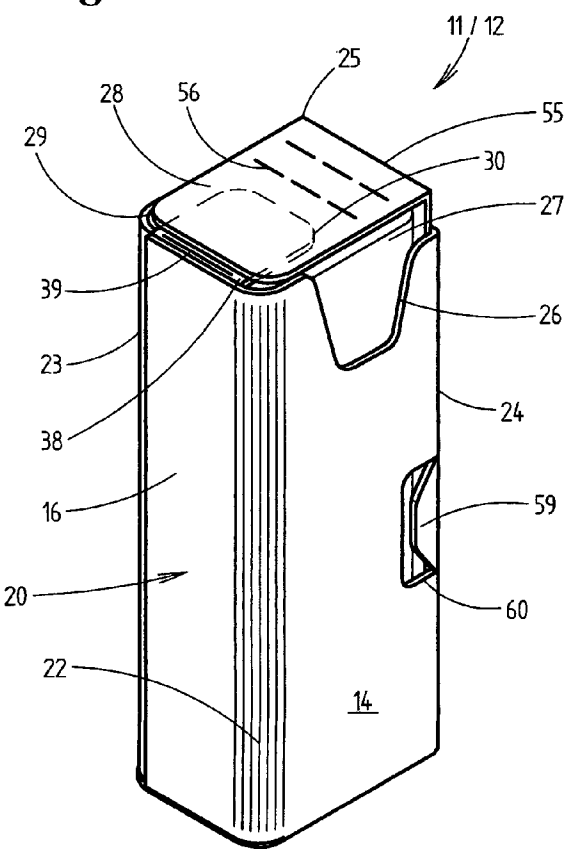
FIG. 4 shows a finished inner packaging in a perspective illustration.

The inner packagings 11, 12 are advantageously provided with closure means on the (top, open) withdrawal side. Said closure means are composed of at least one cover lobe 28 which, in a closed position (FIG. 4), extends substantially over the full dimension of the opening of the inner packaging 11, 12. The cover lobe 28 is matched to the contour of the inner packaging 11, 12, and in the exemplary embodiment shown, is accordingly provided with rounded corners 29. The cover lobe 28 is in the present case formed as a continuation of a side wall of the inner packaging 11, 12, in particular of the inner wall 21. The internal inner lobe 19 is provided with a corresponding elongation for forming the cover lobe 28 (FIG. 1).

The cover lobe 28 interacts with a counterpart lobe, in the present example with a corner lobe 30 which has considerably smaller dimensions and which is arranged opposite on the outer wall 20, specifically on the internal outer lobe 17 of the outer wall 20. In the initial position (FIG. 4), the lobes 28, 30 are folded over one another and connected to one another. The cover lobe 28 and corner lobe 30 accordingly extend in the plane of the open side of the inner packagings 11, 12, directly above the cigarette block 27. The externally situated cover lobe 28 is connected to the internally situated corner lobe 30 by means of an adhesive (glue points 31 in FIG. 7).

The inner packagings 11, 12 are configured, in the region of the inner base wall 13, such that connecting lobes 32, 33 are provided as a continuation of the internal outer lobe 17, that is to say opposite the corner lobe 30, and a connecting lobe 33 is provided as a continuation of the internal inner lobe 19. In the finished inner packaging 11, said folding lobes 32, 33 bear against the inner base wall 13 (FIG. 6).

The cigarette block 27, as contents of an inner packaging 11, 12, is composed of a group of cigarettes which is surrounded on all sides by an inner blank 34 composed of tinfoil, paper, foil or the like. In the example, the inner blank 34 is arranged, in accordance with the longitudinal folding principle, with side lobes 35 and face lobes 36 folded in particular in the manner of an envelope. By means of a transversely oriented punched or perforated line, a flap 37 is created which can be pulled off upon first use and which provides access to the cigarettes. A function of the closing lobes 28, 30 of the inner packaging 11, 12 consists in securing the fold of the inner blank 34, in particular the face lobe 36, during the production of the packaging and subsequently.

For the opening of the inner packaging 11, 12, the closing lobes 28, 30 can be separated from one another—using a corresponding adhesive. In the present case, the inner lobe, specifically the corner lobe 30, is designed and/or arranged such that, when the inner packaging 11, 12 is opened, the corner lobe 30 remains on the cover lobe 28 (inner side). The corner lobe 30 is in this case separated from the connection to the inner packaging 11, 12, in the present case from the internal outer lobe 17. The corner lobe 30 is connected to the folding lobe 17 merely via (two edge-side) residual connections 38. The residual connections are separated from one another by means of a preferably central punched cut 39. When the cover lobe 28 is opened for the first time, the corner lobe 30 is accordingly torn away from the connection, and remains on the inner side owing to the glue connection (FIG. 12).

The outer packaging 10 is composed of a blank (FIG. 2) which is formed, in accordance with the longitudinal folding principle, with an outer base wall 40. The latter is adjoined, via transversely oriented fold lines, by regions or folding lobes of side walls of the laterally open outer packaging 10. Said side walls are a front wall 41 and an opposite rear wall 42. Folding lobes, specifically reinforcement lobes 43, 44, are arranged in each case laterally on the walls 41, 42. Said reinforcement lobes are folded toward the inner side of the outer walls 41, 42 along upright fold lines 51 in a first production step of the outer packaging 10 (FIG. 3). The reinforcement lobes 43, 44 are dimensioned so as to cover substantially the full area of the inner side of the walls 41, 42.

To form a closed, laterally open sleeve, a folding lobe for a top wall 45 of the outer packaging 10 is arranged on one packaging wall, in the present case on the front wall 41. Said top wall is of (approximately) the same size as the outer base wall 40 and—in the case of a design with rounded edges 22, 23—is provided with rounded corners 46. A connecting tab 47 is arranged on a free edge of the top wall 45. Said connecting tab is, in the finished outer packaging 10, connected to the inner side of the rear wall 42, in the present case by means of two groups of glue points 48. Said glue points are advantageously applied to the inner side of the rear wall 42, specifically in the region of an edge-side material strip 49 which is formed by virtue of the reinforcement lobes 43, 44 assigned to the rear wall 42 being of set-back or shortened designed (FIG. 2, FIG. 3). In this way, a multi-layered structure is avoided, because the connecting tab 47 lies flush with the reinforcement lobes 43, 44.

The blank for the outer packaging 10 is provided with punched-out portions, specifically grip openings 50, which in the case of the unfolded blank (FIG. 2) extend across the fold lines 51 to both sides in the region of the walls 41, 42 on the one hand and of the lateral folding lobes 43, 44 on the other hand. When the reinforcement lobes 43, 44 are folded, free grip openings 50 are thus formed on both sides of the walls 41, 42. The open recess thus formed makes it possible for the inner packagings 11, 12 to be manually gripped in order that these can be (partially) pulled out of the outer packaging 10.

Furthermore, punched-out portions are formed in the region of in each case one of the two folding lobes 43, 44, specifically firstly an edge-side recess 52 and secondly, directly adjacent thereto, an elongate punched hole 53 with obliquely inclined edges as support elements for the inner packagings 11, 12. In the folded position (FIG. 3), the punched-out portions 52, 53 form single-layer depressions with corresponding support edges on the inner side of the walls 41, 42. The corresponding configurations of the reinforcement lobes 43 are offset, that is to say arranged on opposite sides of the outer walls 41, 42. In the finished outer packaging 10, too, the engagement means thus formed are arranged on opposite or offset sides.

In the closed position (FIG. 5), the (two) inner packagings 11, 12 bear against one another in an upright position within the outer packaging 10. By being (partially) pulled out, said inner packaging is moved into an open position (FIG. 12, right-hand side), that is to say in the present case into an oblique position. The open position of the inner packaging 11, 12 may be defined by means of stops or connecting elements. In the present case, the cover lobe 28 serves, in the closed position, as an upper cover of the inner packaging 11, 12 (FIG. 12, left-hand side). In the open position, said inner packaging is secured by the cover lobe 28, which, as a retention element, is connected to the top wall 45 of the outer packaging, specifically by means of glue points assigned to each inner packaging 11, 12 or to each cover lobe 28. In the present case, two rows of glue points 54 with in each case six glue points are arranged on the inner side of the top wall 45.

During the opening movement of an inner packaging 11, 12, the cover lobe 28 is formed, with corresponding deformation, from a stretched position with a bend in the region of the transition to the inner lobe 19 into an opposite stretched position or angled position corresponding to the right-hand side of FIG. 12. The cover lobe 28 is therefore provided with a multiplicity of transversely oriented linear joints which are formed by material deformation and/or by punching. In the closed position of the inner packaging 11, 12 (FIG. 12, left-hand side), a main joint 55 defines the right-angled kink of a horizontal cover part into a vertical connecting part to the inner lobe 19. Said part of the cover lobe 28 forms a compensation means owing to the inner wall 21 that is formed with a relatively low height, such that the cover lobe 28 can bear against the inner side of the top wall 45 when the inner packaging is closed.

A further, edge-side linear joint, specifically an opening joint 56, serves for the acute-angled deflection of the cover lobe 28 when an inner packaging 11, 12 (FIG. 12, right-hand side) is in an open position. The joint 56 forms a delimitation with respect to a planar retention limb 57 as part of the cover lobe 28. The retention limb 57 is (permanently) connected to the inner side of the top wall 45, in the present case by means of glue points 54. A rim joint 58—spaced apart from the main joint 55—is situated at the height of an upper free rim edge of the external inner lobe 18. Said transverse joint permits a right-angled or acute-angled deflection of the cover lobe 28 on the upper edge of the internal outer lobe 17 (FIG. 12, right-hand side). A further joint line in the region of the cover lobe 28 serves for ease of deformation thereof during the opening and closing movement. The cover lobe 28 simultaneously serves as a retention and delimiting means for the open position of the inner packaging 11, 12.

The opening and closing positions are furthermore made perceptible using sensory means. The recesses 52 and the punched holes 53 of the outer packaging 10 are assigned a counterpart tab 59 on the associated wall—side wall 14—of the inner packaging 11, 12. The counterpart tab 59 is pivotable about a joint line along the fold line of the packaging edge 24, and is in the form of a projecting tongue. The counterpart tab is situated within a punched-out portion 60 of the side wall 14.

In the closed position of the packaging (FIG. 12, left-hand side), the counterpart tab 59 is situated in its initial position, specifically in the plane of the side wall 14. During the opening movement of the inner packaging 11, 12, a free edge of the counterpart tab 59 initially comes into contact with a free edge of the recess 52 (contour of the reinforcement lobe 43). Here, during continued movement of the inner packaging 11, 12, the counterpart tab 59 is pivoted through approximately 180° and is oriented substantially counter to the original position. Here, the counterpart tab 59 acts as a leaf spring which enters into the punched hole 53 with a noise and in tactile fashion. During the return movement of the inner packaging 11, 12, the processes take place in the reverse sequence.

The inner packagings 11, 12 are fixed in a special way in the region of the outer base wall 40. Owing to U-shaped punching, the latter is provided with articulated tabs 61, 62 at both sides. Each articulated tab is assigned to an inner packaging 11, 12. The articulated tabs 61, 62 are in each case pivotable along transversely oriented linear joints 66, specifically with the associated inner packaging 11, 12 from the horizontal closed position into the obliquely inclined open position (FIG. 12, right-hand side). The inner packagings 11, 12 are connected to said movable or pivotable part of the outer base wall 40, specifically by means of glue points 63. In the present case, each articulated tab 61, 62 is provided with two rows of in each case three glue points 63 (FIG. 9). When the inner packaging 11, 12 is open, the articulated tabs 61, 62 are situated in an oblique plane, corresponding to the oblique inclination of the inner packaging 11, 12.

One special feature is the production of the (complete) packaging. The blank for the inner packagings 11, 12 is firstly prepared with regard to the function of the corner lobe 30 by virtue of the latter being folded through 180° (FIG. 6). In this way, the residual connections 38 are pre-weakened such that, during the opening of the finished packaging, reliable severing of the corner lobe 30 from the outer lobe 17 is ensured. The corner lobe 30 is folded back into the initial position for the further folding process.

Subsequently, the blank of the inner packaging 11, 12 is processed in the manner of a conventional blank for a hinged-lid box. By insertion of the blank into the pocket of a folding turret, parts of the blank or folding lobes, specifically the folding lobes 17 and 19 and a blank limb with the parts 14, 16 and 18, are uprighted. The connecting lobes 32, 33 are, at the same time as the likewise uprighted inner base wall 13, placed into the correct position for the packaging (FIG. 6). The folding lobes 28, 30 are pivoted to the side such that the separately produced cigarette block 27 can be inserted, with a base wall directed forward, into the region of the partially folded blank as far as the base wall 13, specifically while being supported on the side wall 15 situated at the bottom in the plane of movement.

The folding lobes 28, 30, specifically firstly the corner lobe 30 and then the cover lobe 28, are subsequently folded into the closed position so as to produce the connection. The cigarette block 27, and in particular the exposed face-side fold 36, is thereby secured.

The upright limb of the blank (FIG. 7) is folded so as to abut against the cigarette block 27 (FIG. 8). The packaging is introduced into a packaging lane, specifically with the folding lobes 28, 30 pointing forward in the direction of movement. During this period of transport, glue is applied by means of glue nozzles 64 to sidewardly oriented surfaces of the inner packaging 11, 12, in the present case to the internal outer lobe 17 and the internal inner lobe 19. In a further step, the folding lobes 16, 18 are folded so as to abut against the folding lobes 17, 19, and are connected to the latter. The production of the inner packaging 11, 12 is thereby completed.

The outer packaging 10 is also produced by means of special working steps. As per FIG. 9, the (unfolded) blank is initially provided with rows of glue points. In each case two rows of glue points 65 are applied to the front wall 41 and rear wall 42 on both sides of a central line. Said glue points serve for the fixing of the reinforcement lobes 43, 44 that are subsequently folded against the inner side of the front wall 41 and rear wall 42. The glue points 48 for the fixing of the connecting tab 47 may be applied simultaneously and in the same line.

In a common gluing station, the glue points 54 are also applied to the top wall 45 and the glue points 63 are also applied to the articulated tabs 61, 62 of the outer base wall 40.

The blank, provided with the corresponding glue points, of the outer packaging 10 is placed into an angled position with uprighted outer base wall 40 and uprighted rear wall 42 after the folding of the lobes 43, 44, analogously to the inner packagings 11, 12. The two inner packagings 11, 12 that bear against one another by way of the inner walls 21 are then pushed or placed onto the front wall 41. The top wall 45 is subsequently uprighted, and the connecting tab 47 is folded. The upright rear wall 42 is subsequently folded against the two inner packagings 11, 12, wherein a connection to the connecting tab 47 is formed. The production of the packaging is thereby completed.

The inner packagings 11, 12 are produced in corresponding design, specifically either individually in succession or (in the case of two-lane production) adjacent to one another in pairs. In the former case, the successive inner packagings 11, 12 are initially placed together in pairs—correspondingly to the design of the overall packaging. Owing to the relative positions, one of the inner packagings is then rotated through 180° such that the inner walls 21 of the inner packagings 11, 12 that belong together face toward one another (FIG. 9). The counterpart tab 69 and punched-out portion 60 are positioned on opposite sides of the individual packagings 11, 12. The blank of the outer packaging 10 is prepared correspondingly.

The top and bottom walls 40, 45, which are preferably formed with corresponding dimensions, of the outer packaging 10 are preferably formed with slightly larger dimensions than the face-side contours of the inner packagings 11, 12, such that, when the packaging is closed, the outer base wall 40 and the top wall 45 project by way of edge regions slightly beyond the inner packagings 11, 12 in the region of the free open sides.

The present packaging can substantially be produced using conventional packers (for hinge-lid packagings).

LIST OF REFERENCE NUMERALS

10 Outer packaging
11 Inner packaging
12 Inner packaging
13 Inner base wall
14 Side wall
15 Side wall
16 External outer lobe
17 Internal outer lobe
18 External inner lobe
19 Internal inner lobe
20 Outer wall
21 Inner wall
22 Rounded edge
23 Rounded edge
24 Packaging edge
25 Packaging edge
26 Recess
27 Cigarette block
28 Cover lobe
29 Rounded corner
30 Corner lobe
31 Glue point
32 Connecting lobe
33 Connecting lobe
34 Inner blank
35 Side lobe
36 End lobe
37 Flap
38 Residual connection
39 Punched cut
40 Outer base wall
41 Front wall
42 Rear wall
43 Reinforcement lobe
44 Reinforcement lobe
45 Top wall
46 Rounded corner
47 Connecting tab
48 Glue point
49 Material strip
50 Grip opening
51 Fold line
52 Recess
53 Punched hole
54 Glue point
55 Main joint
56 Opening joint
57 Retaining limb
58 Rim joint
59 Counterpart tab
60 Punched-out portion
61 Articulated tab
62 Articulated tab
63 Glue point
64 Glue nozzle
65 Glue point
66 Linear joint

The invention claimed is:

1. A packaging for cigarettes, comprising an outer packaging and at least one inner packaging arranged in said outer packaging, for holding the cigarettes, wherein the inner packaging can be pivoted about a joint line in the region of an outer base wall of the outer packaging from a closed position within the outer packaging into an obliquely oriented open position partially outside the outer packaging, and wherein the inner packaging and the outer packaging are formed or folded in accordance with the principle of longitudinal folding, and a blank of the inner packaging is formed such that, an inner base wall is adjoined, at both sides, to folding lobes for mutually opposite side walls and for mutually opposite outer and inner walls, and wherein:

a) the side walls of the inner packaging are of single-layer form and the outer wall and the inner wall are of double-layer form owing to approximately complete overlap of external and internal outer lobes and external and internal inner lobes, which are connected to the side walls, b) a blank of the outer packaging has folding lobes for a front wall and for an opposite rear wall, respectively, said folding lobes being arranged to both sides of an outer base wall and being integrally connected to the latter, c) a top wall of the outer packaging is integrally connected to the front wall or to the rear wall, d) the top wall is connected to the rear wall or to the front wall by a connecting tab, e) the inner packaging is cup-shaped and is closed at a top side when in the closed position within the outer packaging, by tabs of the inner packaging, which tabs open up the top side of the inner packaging during the movement into the open position, f) a cover lobe is connected to the internal inner lobe of the double-layer inner wall, and g) a retaining limb of the cover lobe is fastened to the top wall of the outer packaging, wherein the retaining limb remains fastened to the top wall when the inner packaging is in the closed position and in the open position, wherein the cover lobe serves as an upper cover of the inner packaging when the inner packaging is in the closed position, and serves as a limitation means for the oblique orientation of the inner packaging when the latter is in the open position, h) wherein the cover lobe comprises an opening joint forming a delimitation with respect to the retaining limb, a rim joint situated at the height of an upper free rim edge of the external inner lobe, and a main joint situated between the opening joint and the rim joint such that, when the inner packaging is in the closed position, the cover lobe is substantially parallel to the top wall of the outer packaging between the opening joint and the main joint and, when the inner packaging is in the closed position, the cover lobe is substantially perpendicular to the top wall of the outer packaging between the main joint and the rim joint.

2. The packaging as claimed in claim 1, wherein:

a) the inner base wall is directly adjoined by the folding lobes for the side walls and the double-layer outer wall and the double-layer inner wall, b) the outer lobes of the outer wall are connected to the respectively adjacent side wall via rounded edges or via oblique edges.

3. The packaging as claimed in claim 1, wherein the outer wall and the inner wall are formed with different height dimensions, such that the outer wall substantially corresponds to an inner height dimension of the outer packaging and the inner wall is recessed in relation to the top wall of the outer packaging, such that a cigarette block when placed in the inner packaging projects, at a top side, beyond the inner wall when the inner packaging is in the open position.

4. The packaging as claimed in claim 1, wherein the inner packaging is closed at the top side during production by tabs of the inner packaging, which tabs open up the top side of the inner packaging during the movement into the open position.

5. The packaging as claimed in claim 1, the inner packaging when in the open position can be closed by the cover lobe arranged on the inner wall and by an opposite corner lobe which is connected to the internal outer lobe of the double-layer outer wall, wherein the corner lobe lies against the inner side of the cover lobe when the inner packaging is in the closed position.

6. The packaging as claimed in claim 5, wherein:

a) during the production of the packaging, the corner lobe is connected to the cover lobe by glue-on-glue points, b) the corner lobe is connected to the outer lobe by residual connections, c) the residual connections can be severed when the packaging is opened for the first time.

7. The packaging as claimed in claim 1, wherein the cover lobe extends substantially over a full width and depth of an open side of the inner packaging and is, by way of a partial region, connected to the top wall of the outer packaging in a region of the retaining limb by glue.

8. The packaging as claimed in claim 1, wherein the cover lobe is composed of thin cardboard and has multiple transversely oriented linear joints formed by material deformation, said linear joints comprising a main joint for deflection of the cover lobe into the region of the internal inner lobe of the inner wall and a rim joint for deflection of the cover lobe on the upper edge of the inner lobe in the open position of the inner packaging.

9. The packaging as claimed in claim 1, wherein one recess and one punched hole are formed in the region of the outer packaging at diametrically opposite positions of the front wall and of the rear wall, such that they interact with counterpart recesses and punched holes of the inner packaging to provide tactile and/or audible identification of the open position of the inner packaging.

10. The packaging as claimed in claim 1, wherein the outer base wall of the outer packaging has, owing to a U-shaped punching of each inner packaging, associated articulated tabs with a linear joint transversely in the outer base wall, wherein each inner packaging is fastened by way of an inner base wall to the associated articulated tab by glue.

11. A packaging for cigarettes, comprising an outer packaging and at least one inner packaging arranged in said outer packaging, for holding the cigarettes, wherein the inner packaging can be pivoted about a joint line in the region of an outer base wall of the outer packaging from a closed position within the outer packaging into an obliquely oriented open position partially outside the outer packaging, and wherein the inner packaging and the outer packaging are formed or folded in accordance with the principle of longitudinal folding, and a blank of the inner packaging is formed such that, an inner base wall is adjoined, at both sides, to folding lobes for mutually opposite side walls and for mutually opposite outer and inner walls, and wherein:

a) the side walls of the inner packaging are of single-layer form and the outer wall and the inner wall are of double-layer form owing to approximately complete overlap of external and internal outer lobes and external and internal inner lobes, which are connected to the side walls, b) a blank of the outer packaging has folding lobes for a front wall and for a rear wall, respectively, said folding lobes being arranged to both sides of an outer base wall and being integrally connected to the latter, c) a top wall of the outer packaging is integrally connected to the front wall or to the rear wall, d) the top wall is connected to the rear wall or to the front wall by a connecting tab;

e) one recess and one punched hole are formed in the region of the outer packaging at diametrically opposite positions of the front wall and of the rear wall, such that they interact with counterpart recesses and punched holes of the inner packaging to provide audible identification of the open position of the inner packaging;

f) a cover lobe is connected to the inner packaging; and g) a retaining limb of the cover lobe is fastened to the top wall of the outer packaging and remains fastened to the top wall when the inner packaging is in the closed position and in the open position, h) wherein the cover lobe comprises an opening joint forming a delimitation with respect to the retaining limb, a rim joint situated at the height of an upper free rim edge of the external inner lobe, and a main joint situated between the opening joint and the rim joint such that, when the inner packaging is in the closed position, the cover lobe is substantially parallel to the top wall of the outer packaging between the opening joint and the main joint and, when the inner packaging is in the closed position, the cover lobe is substantially perpendicular to the top wall of the outer packaging between the main joint and the rim joint.

12. The packaging as claimed in claim 11, wherein:

a) the inner base wall is directly adjoined by the folding lobes for the side walls and the double-layer outer wall and the double-layer inner wall, b) the outer lobes of the outer wall are connected to the respectively adjacent side wall via rounded edges or via oblique edges.

13. The packaging as claimed in claim 12, wherein the outer wall and the inner wall are formed with different height dimensions, such that the outer wall substantially corresponds to an inner height dimension of the outer packaging and the inner wall is recessed in relation to the top wall of the outer packaging, such that a cigarette block when placed in the inner packaging projects, at a top side, beyond the inner wall when the inner packaging is in the open position.

14. The packaging as claimed in claim 13, wherein:

a) the inner packaging is cup-shaped and is closed at a top side during production and when in the closed position within the outer packaging, by tabs of the inner packaging, which tabs open up the top side of the inner packaging during the movement into the open position.

15. The packaging as claimed in claim 14, wherein the inner packaging when in the open position can be closed by the cover lobe arranged on the inner wall and by an opposite corner lobe which is connected to the internal outer lobe of the double-layer outer wall, wherein the corner lobe lies against the inner side of the cover lobe when the inner packaging is in the closed position.

* * * * *